US011415393B2

(12) United States Patent
Coil

(10) Patent No.: US 11,415,393 B2
(45) Date of Patent: Aug. 16, 2022

(54) RIFLE SCOPE ALIGNMENT APPARATUS

(71) Applicant: Nathan Coil, Gillette, WY (US)

(72) Inventor: Nathan Coil, Gillette, WY (US)

( * ) Notice: Subject to any disclaimer, the term of this patent is extended or adjusted under 35 U.S.C. 154(b) by 78 days.

(21) Appl. No.: 17/138,675

(22) Filed: Dec. 30, 2020

(65) Prior Publication Data

US 2022/0205761 A1 Jun. 30, 2022

(51) Int. Cl.
*F41G 1/54* (2006.01)
*F41G 1/12* (2006.01)

(52) U.S. Cl.
CPC ..... *F41G 1/545* (2013.01); *F41G 1/12* (2013.01)

(58) Field of Classification Search
CPC ..... F41G 1/545; F41G 1/12
USPC ..... 42/111
See application file for complete search history.

(56) References Cited

U.S. PATENT DOCUMENTS

| | | | | |
|---|---|---|---|---|
| 5,499,455 | A * | 3/1996 | Palmer | F41G 1/545 42/120 |
| 5,878,504 | A | 3/1999 | Harms | |
| 9,115,957 | B1 * | 8/2015 | Winker | F41G 3/323 |
| 9,448,038 | B2 * | 9/2016 | Palmer | F41G 1/545 |
| 10,648,773 | B2 * | 5/2020 | Owens | F41G 1/38 |
| 2013/0283661 | A1 | 10/2013 | Lynn | |
| 2018/0274886 | A1 * | 9/2018 | Goddard | F41G 1/545 |

OTHER PUBLICATIONS

"Level Right Pro" by Real Avid [product page from website https://www.realavid.com/product/level-right-pro/] (Year: 2020).*

* cited by examiner

*Primary Examiner* — Samir Abdosh
(74) *Attorney, Agent, or Firm* — Peter J. Timbers

(57) ABSTRACT

A rifle scope alignment apparatus having a light source that shines through a void space and through a rifle scope. The rifle scope alignment apparatus has two stepped wedges that engage the front end of a rifle scope and has a flat top v-groove to engage a rifle barrel. The light source illuminates the crosshairs of the rifle scope which casts a shadow of the crosshairs onto an elevated diamond-shaped target having a rounded hole and a vertical line and horizontal line.

14 Claims, 14 Drawing Sheets

RIFLE SCOPE ALIGNMENT APPARATUS

FIELD OF THE INVENTION

The present invention relates to a rifle scope alignment apparatus having a leveled base and stepped wedges that engage a rifle scope mounted to a rifle and the apparatus capable of aligning the rifle barrel and scope both vertically and horizontally to the shooter's desired alignment specifications.

BACKGROUND OF THE INVENTION

Rifle scope alignment apparatuses typically attempt to align the rifle barrel and the scope through a variety of means. Nevertheless, its needed in the rifle scope alignment art to rigorously align both the vertical and horizontal crosshairs of the rifle scope to the rifle barrel with a completely level target. There exists a long felt need for an apparatus to provide complete vertical and complete horizontal alignment for the scope relative to the rifle barrel.

SUMMARY OF THE INVENTION

Accordingly, it is an object of embodiments of the present invention to provide for a rifle scope alignment apparatus. Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. To achieve the foregoing and other objects, and in accordance with the purposes of the present invention, as embodied and broadly described herein, the invention comprises a rifle scope alignment apparatus comprising a top brace, a bottom brace, a light source, a light source chassis, a cavity, a flat top v-groove, a level, a posterior portion, and an anterior; said anterior portion comprised of said first stepped wedge and a second stepped wedge, and said first stepped wedge in contact with said top brace and said bottom brace; said second wedge disposed opposing said first stepped wedge, and said second stepped wedge in contact with said top brace and said bottom brace; said cavity disposed between said top brace and said bottom brace, said cavity disposed between said anterior portion and said posterior portion, and said cavity disposed between said first stepped wedge and said second stepped wedge; said first stepped wedge and said second stepped wedge adapted to contact a rifle scope front end; said light source chassis in contact with said posterior portion, said light source chassis in contact with said light source; said flat top v-groove attached to said bottom brace, and said flat top v-grove adapted to be attached to a rifle barrel; and said level attached to said top brace. In another embodiment of the instant invention, the rifle scope apparatus comprises an elevated diamond-shaped target having a top portion and a centrally located and circular hole disposed at the top portion. And in yet a further embodiment of the instant invention, the rifle scope apparatus invention comprises the elevated diamond-shaped target further comprising an anterior surface, the anterior surface further comprising a vertical line and a horizontal line disposed beneath the centrally located and circular hole, the vertical line intersects the horizontal line.

Benefits and advantages of the present invention include, but are not limited to providing rifle scope alignment apparatus having two opposing stepped wedges that engage the front end of a rifle scope and a light source between the two stepped wedges that illuminates the cross hairs of a rifle scope and casts the shadows of the cross hairs onto a diamond-shaped target having a rounded hole at it top portion and a vertical and a horizontal line dividing the diamond-shaped target roughly equally into four quadrants.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION AND DRAWINGS

Figure 1:
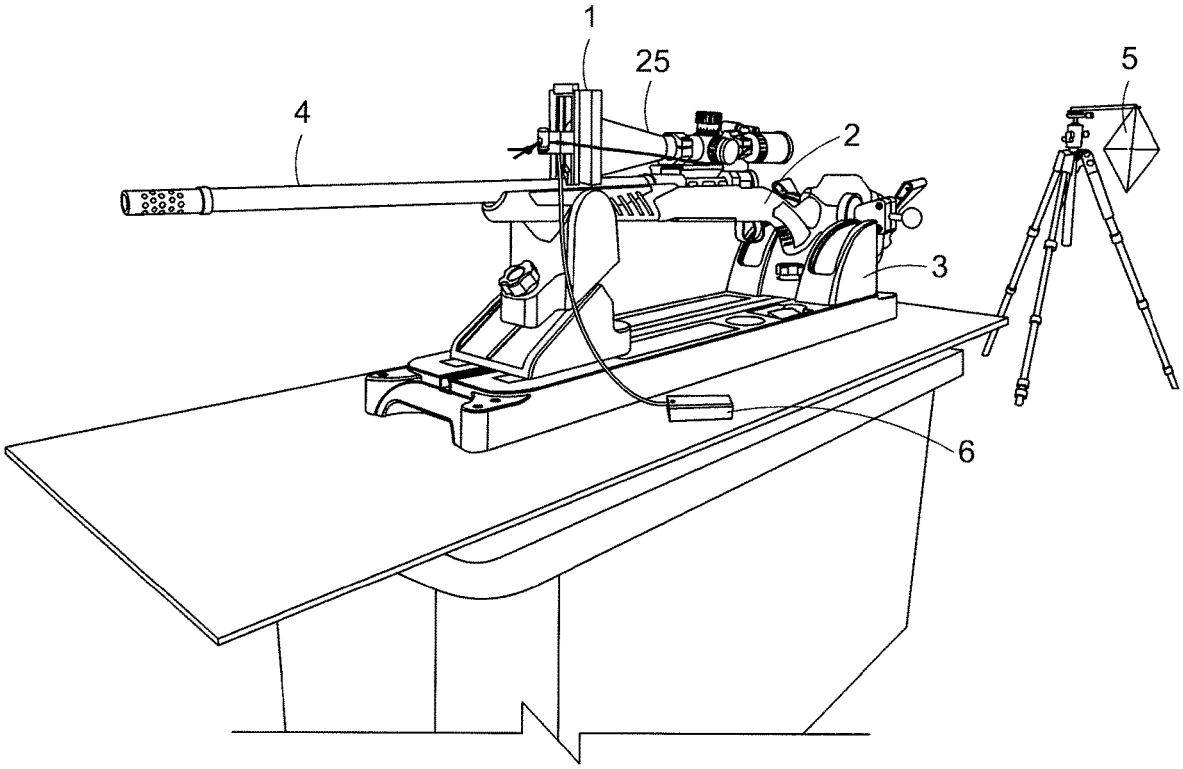
FIG. 1 illustrates a side perspective view of one embodiment of the instant invention wherein the rifle scope alignment apparatus sits atop a rifle barrel and contacts a rifle scope and the elevated diamond-shaped target is disposed a distance from the rifle scope.

Reference will now be made in detail to embodiments of the invention, examples of which are illustrated in the accompanying drawings. Throughout the following detailed description, the same reference characters refer to the same or similar elements in all Figures. In this detailed description, reference is to a few embodiments of the instant invention, as illustrated in the accompanying and above-referenced drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

FIG. 1 is one embodiment of the instant invention that depicts a rifle scope apparatus one sitting atop the barrel 4 of a firearm 2. The rifle scope apparatus one is attached to the barrel end of the rifle scope 25. Figure one further depicts the rifle 2 mounted on a shooting rest 3. Further the rifle scope apparatus one has a power supply 6 for the light source attached to the posterior side of the rifle scope alignment apparatus 1. In actual use, the light source contained in the rifle scope apparatus 1 shines light through the rifle scope 25 and projects in the shadows of the crosshair onto the diamond-shaped target 5.

Figure 2:
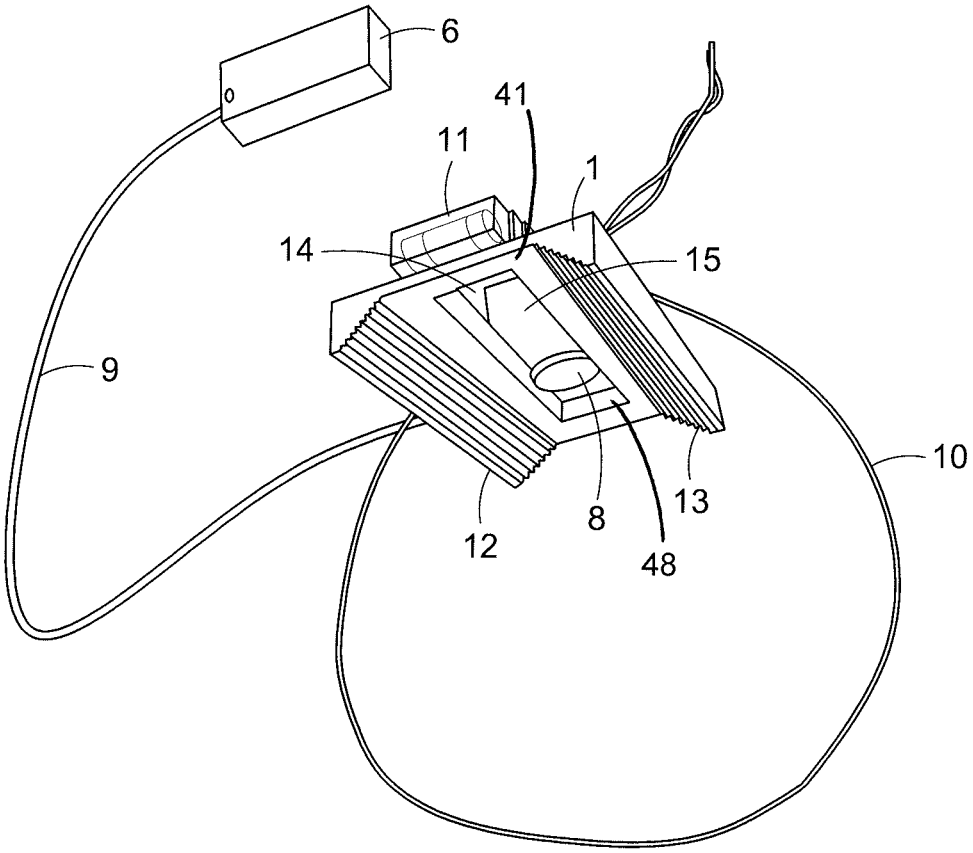
FIG. 2 illustrates a top and side perspective view of one embodiment of the instant invention.

FIG. 2 depicts the rifle scope alignment apparatus 1 having a top brace 41, a bottom brace 48, a light source 8, a level 11, disposed atop the top brace 41, and anterior portion having a first stepped wedge, 12, a second stepped wedge 13, which opposes the first stepped wedge 12, and a cavity 14 extending from the anterior portion through the posterior portion and disposed between the first stepped wedge 12 and the second stepped wedge 13 and between the top brace 41 and the bottom brace 48. The light source 8 is powered by a power source 6 that supplies power to the light via cord 9. The rifle scope alignment apparatus 1 is attached to the rifle and scope and snuggly connected via the attachment cord 10.

Figure 3:
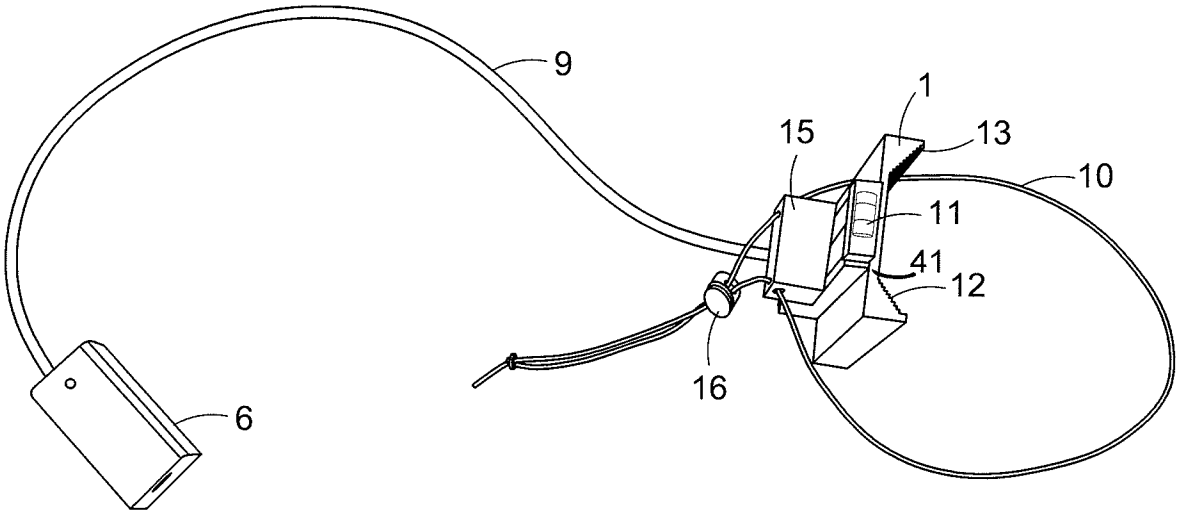
FIG. 3 illustrates a top and side rear perspective view one embodiment of the instant invention.

FIG. 3 depicts the light power source 6 and power cord 9 connected to the light source chassis 15 on the posterior side of the rifle scope alignment apparatus 1. Also depicted is the first step wedge 12 and the second step wedge 13 and the top brace 41 therebetween. The attachment cord 10 is shown connected to the light source chassis 15 and the attachment cord 10 can be drawn tight via the fastener 16. A level 11 is disposed atop the top brace 41 of the rifle scope alignment apparatus 1. The light source chassis 15 has holes to secure the cord 10 and thereby provide a means to attach firmly the rifle scope alignment apparatus 1 to the rifle scope.

Figure 4:
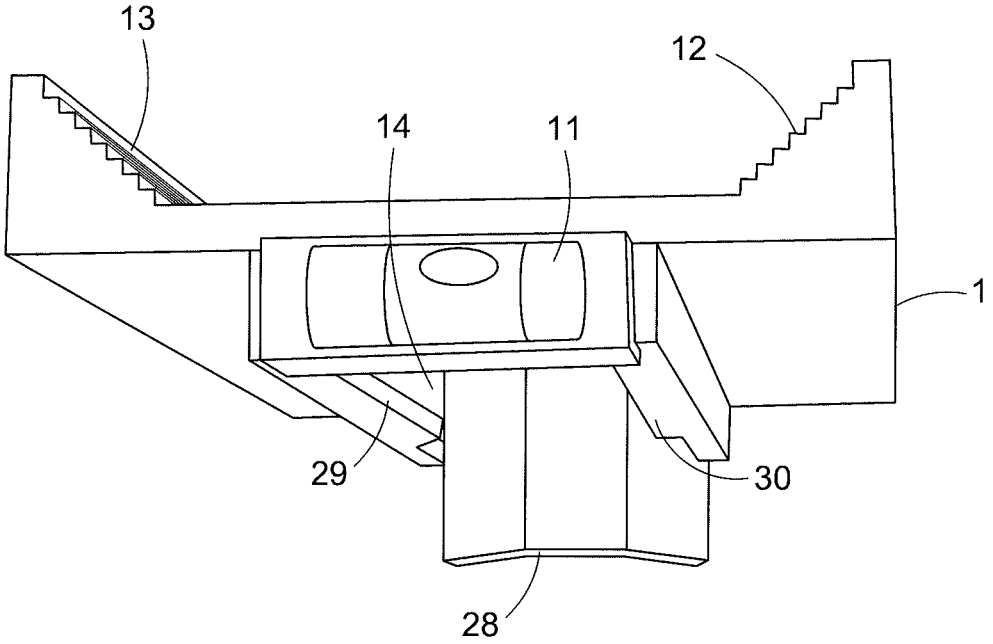
FIG. 4 illustrates a top and side rear perspective view of one embodiment of the instant invention.

FIG. 4 depicts the rifle scope alignment apparatus 1 having a level 11 atop of the top brace 41, and anterior portion having a first stepped wedge, 12, a second stepped wedge 13 opposing the first stepped wedge 12, and a cavity 14 extending from the anterior portion through the posterior portion and disposed between the first stepped wedge 12 and the second stepped wedge 13 and between the top portion and the bottom portion. FIG. 4 further depicts a first rail 30 and a second rail 29 on either side of the void space 14, which will provide a mechanism for the light source to move vertically up and down the void space 14 of the rifle scope alignment apparatus one. Additionally, at the bottom of the rifle scope alignment apparatus one FIG. 4 depicts a flat top v-groove 28 attached to the bottom brace 48 of the rifle scope alignment apparatus 1. The flat top v-groove 28 will attach to the barrel of the rifle.

Figure 5:
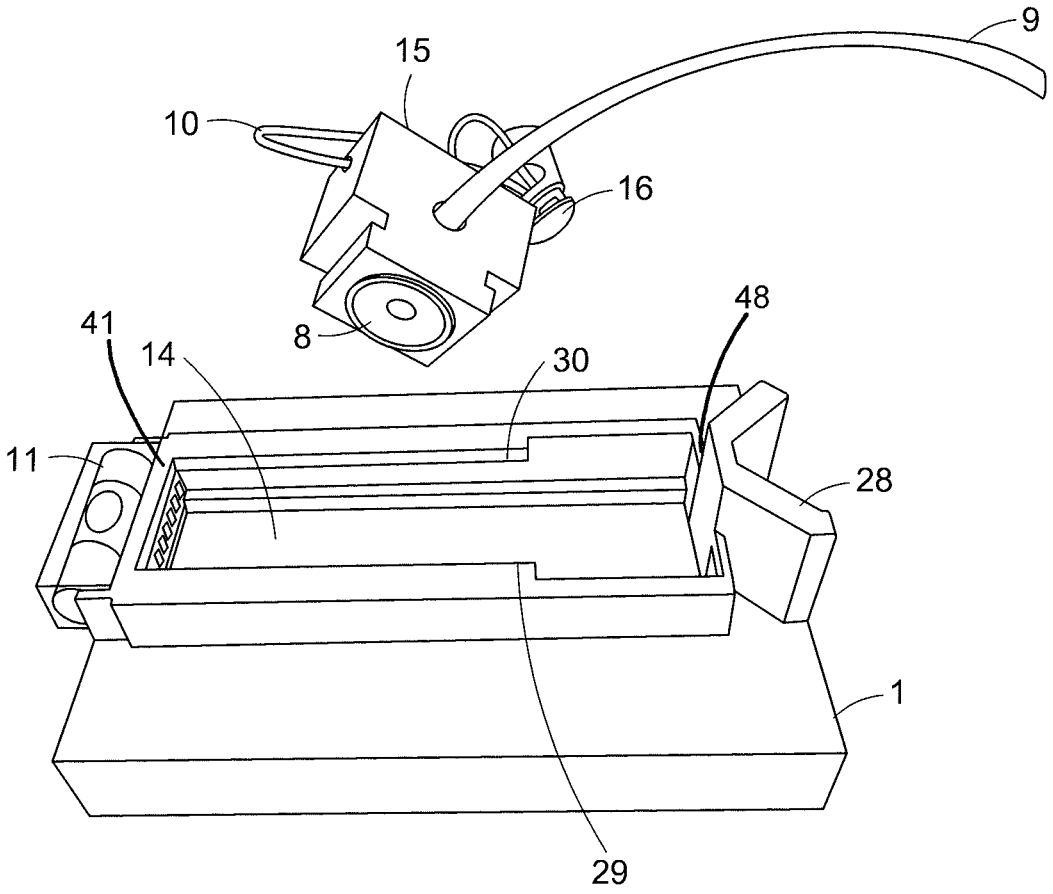
FIG. 5 illustrates a side and top rear perspective view of one embodiment of the instant invention depicting the light source to be inserted into the rifle scope alignment apparatus.

FIG. 5 depicts the rifle scope alignment apparatus 1 having a level 11 atop the top brace 41, a void space 14 between the first rail 30 and the second rail 29. The void space extends from the top brace 41 of the rifle scope alignment apparatus 1 to the bottom brace 48 of the rifle scope alignment apparatus 1. Additionally, FIG. 5 further depicts both the light source 8 and the power cord 9 both attached to the light source chassis 15. Further, the light source chassis 15 has holes that accommodate the cord 10 for attachment to the rifle scope and the fastener 16 to pull the cord 10 tight.

Figure 6:
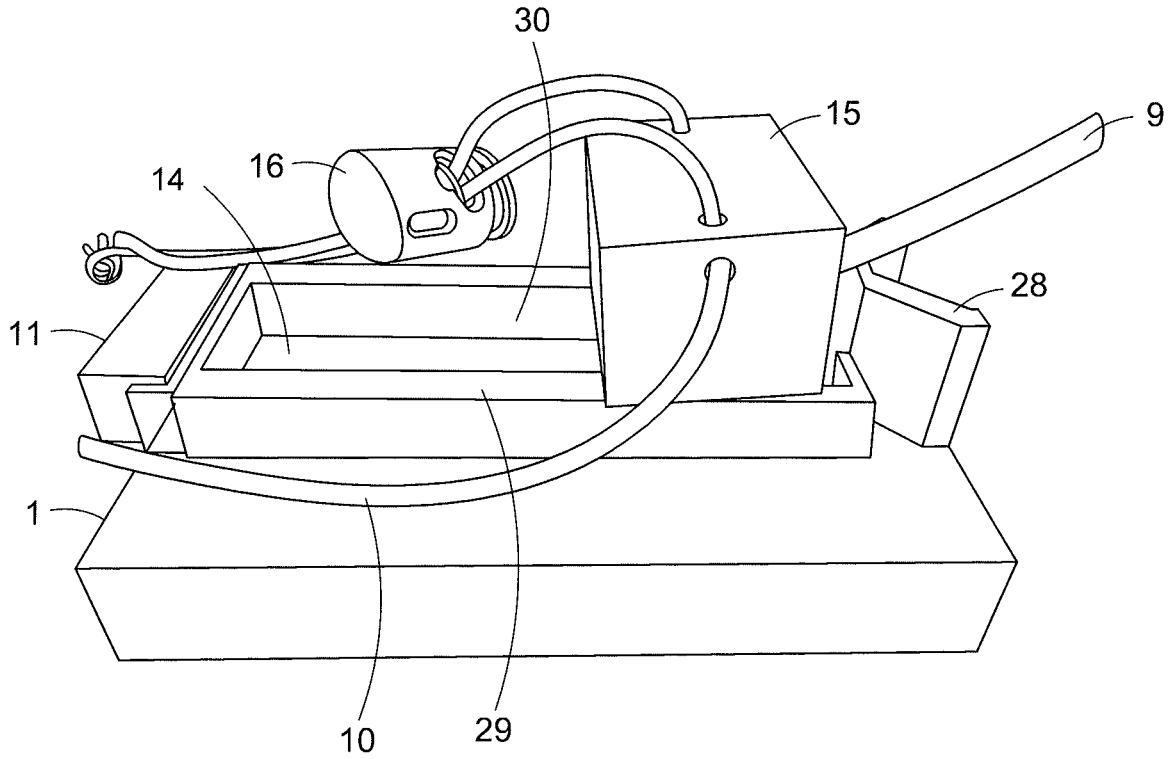
FIG. 6 illustrates a side and top rear perspective view of one embodiment of the instant invention depicting the insertion of the light source and light source chassis into the rifle scope alignment apparatus.

FIG. 6 depicts the rifle scope alignment apparatus 1 having a level 11 near the top brace 41, a void space 14 between the first rail 30 and the second rail 29 and the void space extending from the top portion of the rifle scope alignment apparatus 1 and proximal to the level 11 to the bottom portion of the rifle scope alignment apparatus 1 and proximal to the flat top v-grove 28. Additionally, FIG. 5 further depicts the light source 8 being inserted into the void space 14 of the rifle scope alignment apparatus 1. Both the power cord 9 and the cord are attached to the light source chassis 15. The cord 10 runs through the fastener 16 to pull the cord 10 tightly attaching the rifle scope alignment apparatus 1 to the rifle scope.

Figure 7:
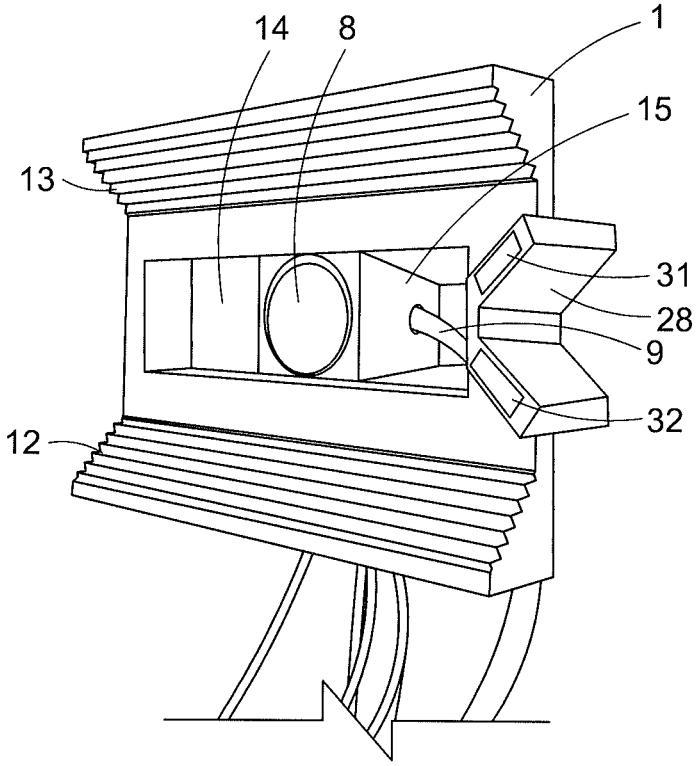
FIG. 7 illustrates front view of one embodiment of the instant invention.

FIG. 7 depicts the rifle scope alignment apparatus 1 wherein the light source eight and the light source chassis 15 are attached to the rifle scope alignment apparatus 1. The light source eight and light source chassis 15 can move freely through the void space 14. This allows light source to accommodate various heights of rifle scopes mounted on rifles. FIG. 7 further depicts the first stepped wedge 12 and the second stepped wedge 13. FIG. 7 also depicts the flat top v-grove 28 having a first magnetic 32 and a second magnetic 31 in order to attach securely the rifle scope alignment apparatus 1 to the barrel of the rifle.

Figure 8:
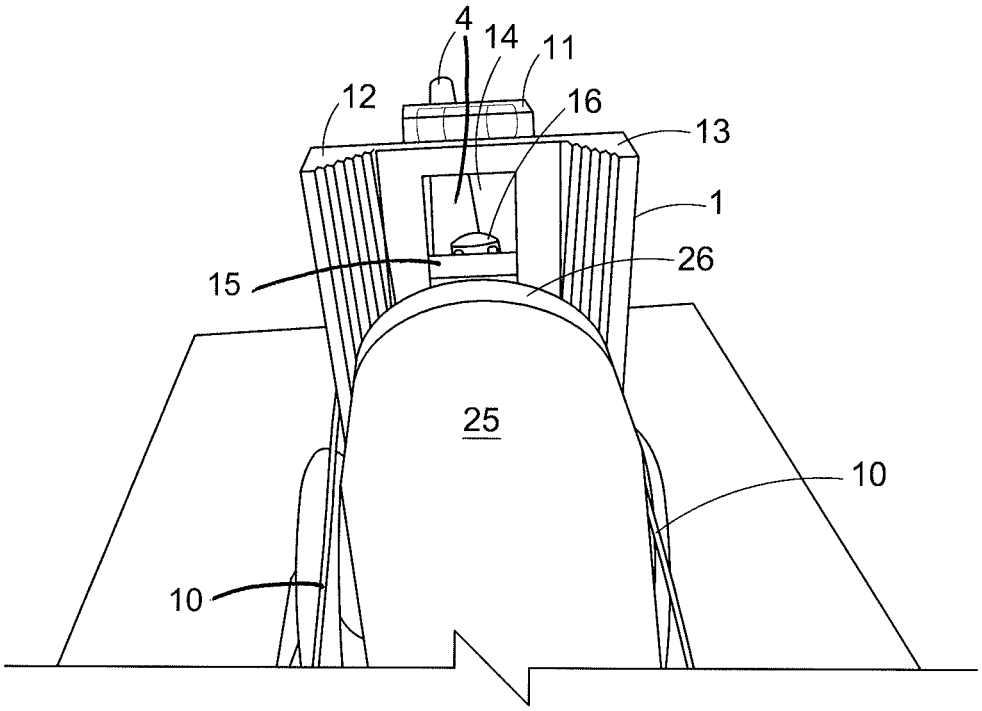
FIG. 8 illustrates a top and front perspective view of one embodiment of the instant invention wherein the rifle scope alignment apparatus is attached to the rifle and the rifle scope.

FIG. 8 the rifle scope alignment apparatus 1 attached to the scope of the rifle scope 25 at the point of the front end of the rifle scope 26. The rifle scopes front end 26 engages the first stepped wedge 12 and second stepped wedge 13 on parallel and opposite side steps of the first stepped wedge 12 and the second stepped wedge 13. FIG. 8 also depicts a view through the void space 14 of the fastener 16 and the light source chassis 15. The rifle barrel 4 can be seen through the void space 14 as well as above the level 11. The cord 10 is shown on both sides of the rifle scope 25.

Figure 9A:
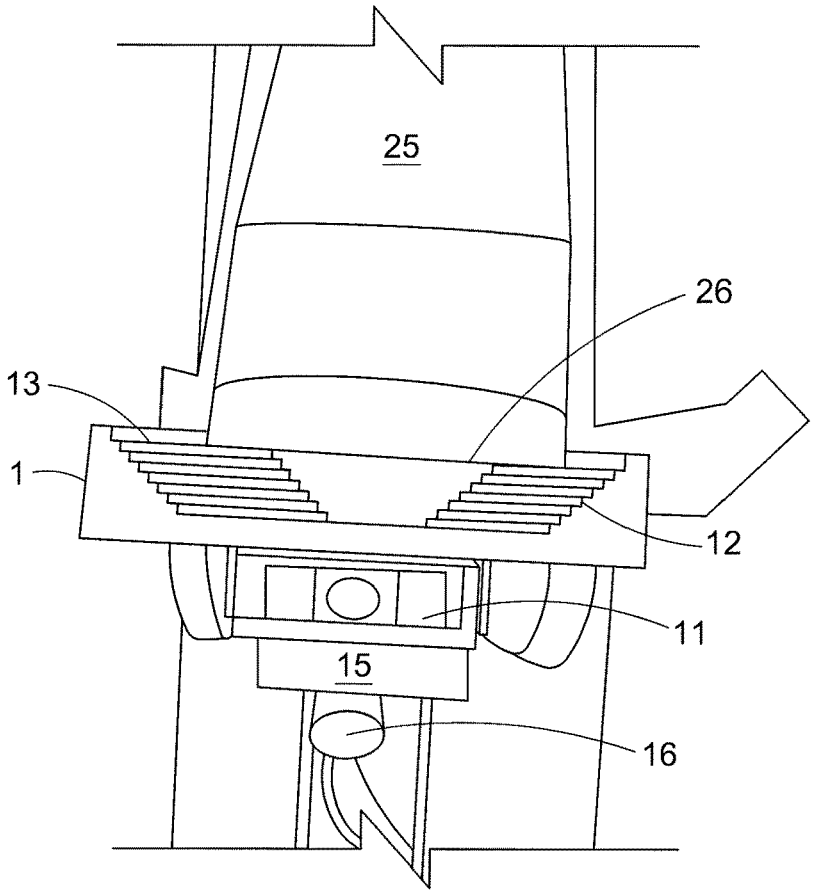
FIG. 9A illustrates a top view of one embodiment of the instant invention depicting the rifle scope alignment apparatus attached to the rifle scope.

FIG. 9A, a top-down view of the rifle scope alignment apparatus 1, depicts the contact point between the front end of the rifle scope 26 of the rifle scope 25 and the first stepped wedge 12 and the second stepped wedge 13. FIG. 9A also depicts the light source chassis 15, the level 11 on top of the rifle scope alignment apparatus 1 and the fastener 16 for the cord.

Figure 9B:
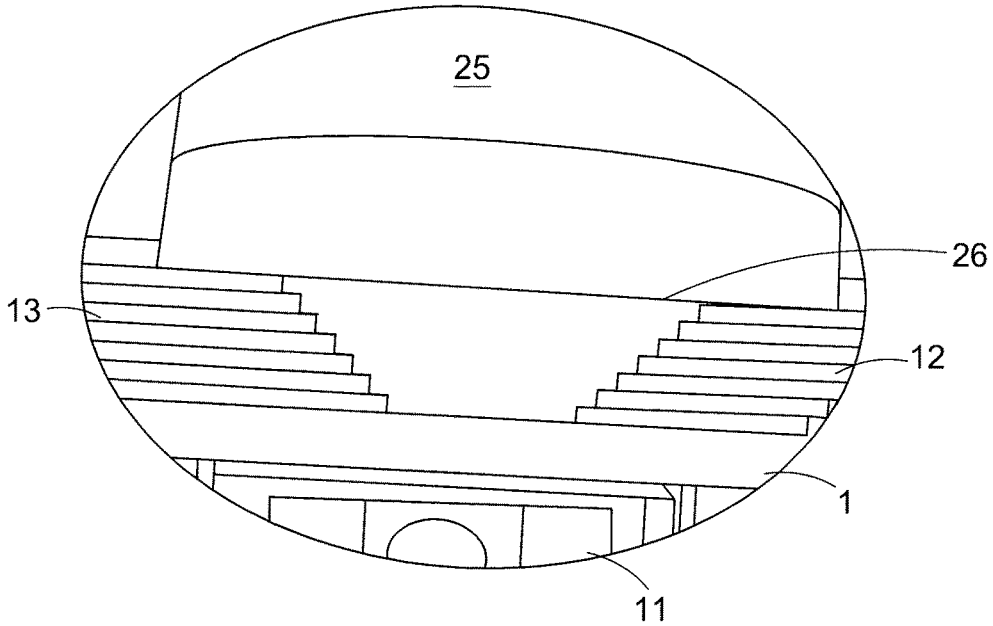
FIG. 9B illustrates a closeup view of the attachment of the rifle scope alignment apparatus to the rifle scope.

FIG. 9B is a close-up of 9A showing the contact point between the front end of the rifle scope 26 and the first stepped wedge 12 and the second stepped wedge 13. The specific point of contact is on the seventh stepped of both the first stepped wedge 12 and the second stepped wedge 13. Also depicted in FIG. 9B is the level 11 of the rifle scope alignment apparatus 1.

Figure 10:
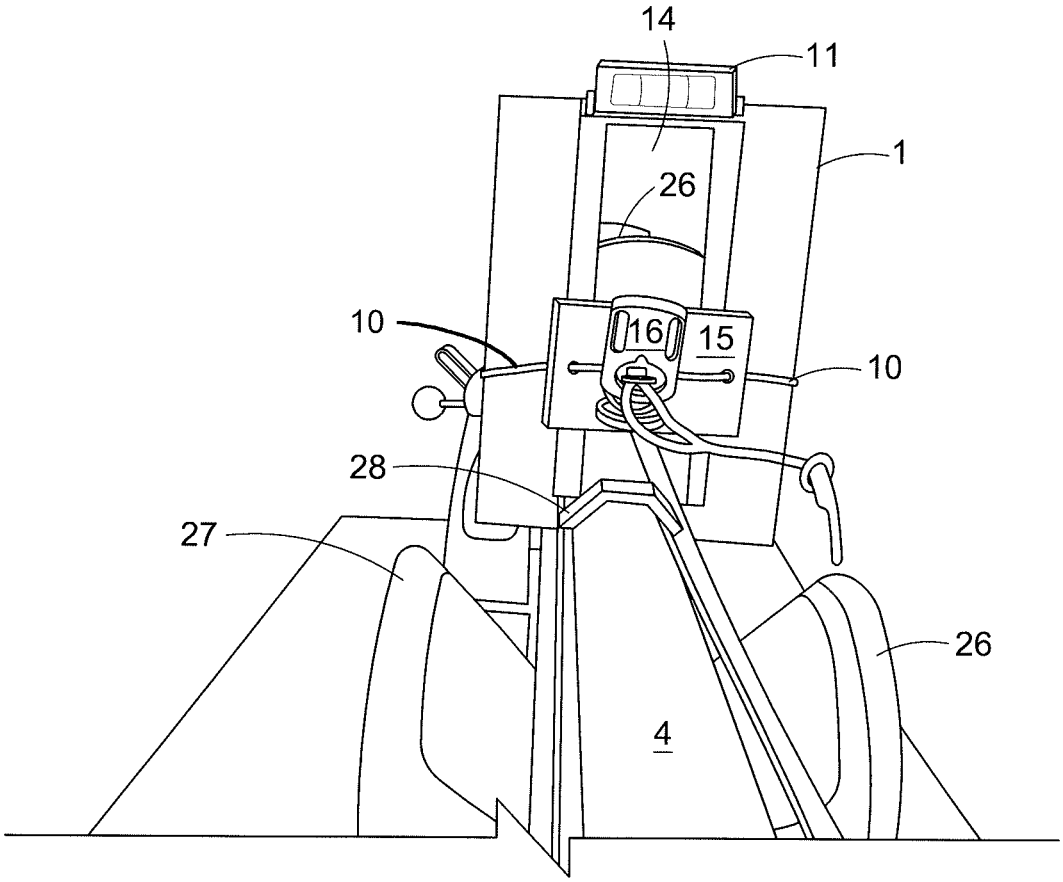
FIG. 10 illustrates a rear top perspective view of one embodiment of the instant invention depicting the attachment of the rifle scope alignment apparatus to the rifle barrel.

FIG. 10 depicts the posterior side of the rifle scope alignment apparatus 1. The light source chassis 15 secures the cord 10 that is attaches to the remainder of the rifle scope. The front end of the rifle scope 26 is viewed through the void space 14 and is the rifle scopes contact with the first stepped wedge (not depicted) and the second stepped wedge (not depicted) on the anterior portion is not shown. The cord 10 is held taut by the fastener 16. The flat top v-grove 28 contacts the rifle scope 4 that is held in place by the first pad 26 and second pad 27 of the rest 3 of FIG. 1 (not depicted). The level 11 is disposed at the top of the top brace of the rifle scope alignment apparatus 1. The rifle scope alignment apparatus 1 can be horizontally leveled using the level 11.

Figure 11:
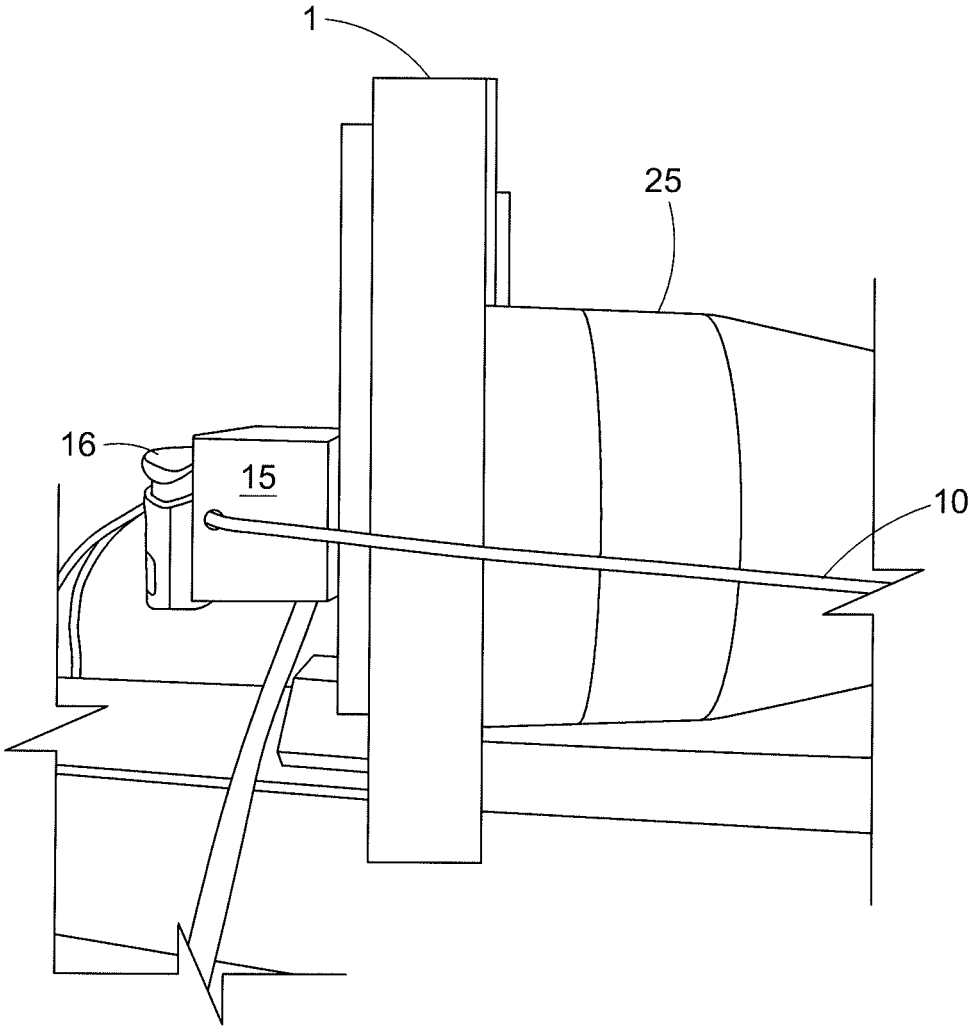
FIG. 11 illustrates a side view of one embodiment of the instant invention wherein the rifle scope alignment apparatus is attached to the rifle scope.

FIG. 11 shows the rifle scope alignment apparatus one attached to the rifle scope 25. The cord 10 is pulled taut and held tightly by the fastener 16 attached to the light source chassis 15. The tight attachment creates stability for the light source (not depicted) light to shine through the rifle scope 25 and onto the crosshairs of the rifle scope 25. Stability of the light source is important during rifle scope alignment processes.

Figure 12:
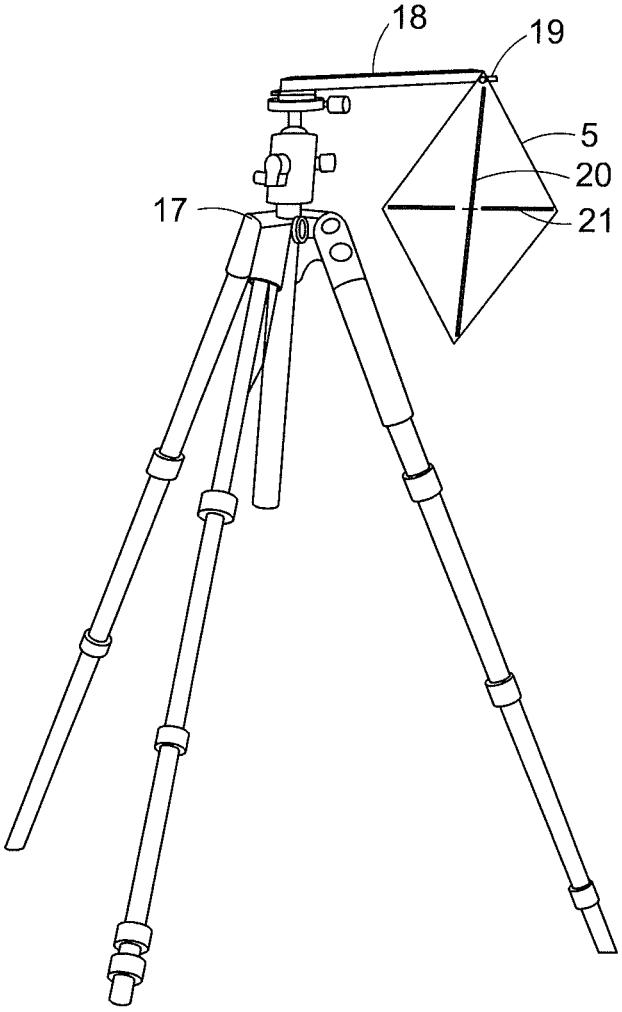
FIG. 12 illustrates another embodiment of the instant invention depicting the elevated diamond-shaped target.

FIG. 12 depicts a tripod 17 that elevates a holding arm 18 having a pin 19 that penetrates a rounded hole in an elevated diamond-shaped target 5. A vertical line 20 is symmetrically disposed on the diamond-shaped target 5, dividing the target into two halves, a right half and a left half. A horizontal line 21 is symmetrically disposed on the diamond-shaped target 5, dividing the target into two halves, a top half and a bottom half. The tripod 17 is disposed at a distance from the rifle stock (back end of the rifle), which is not depicted.

Figure 13A:
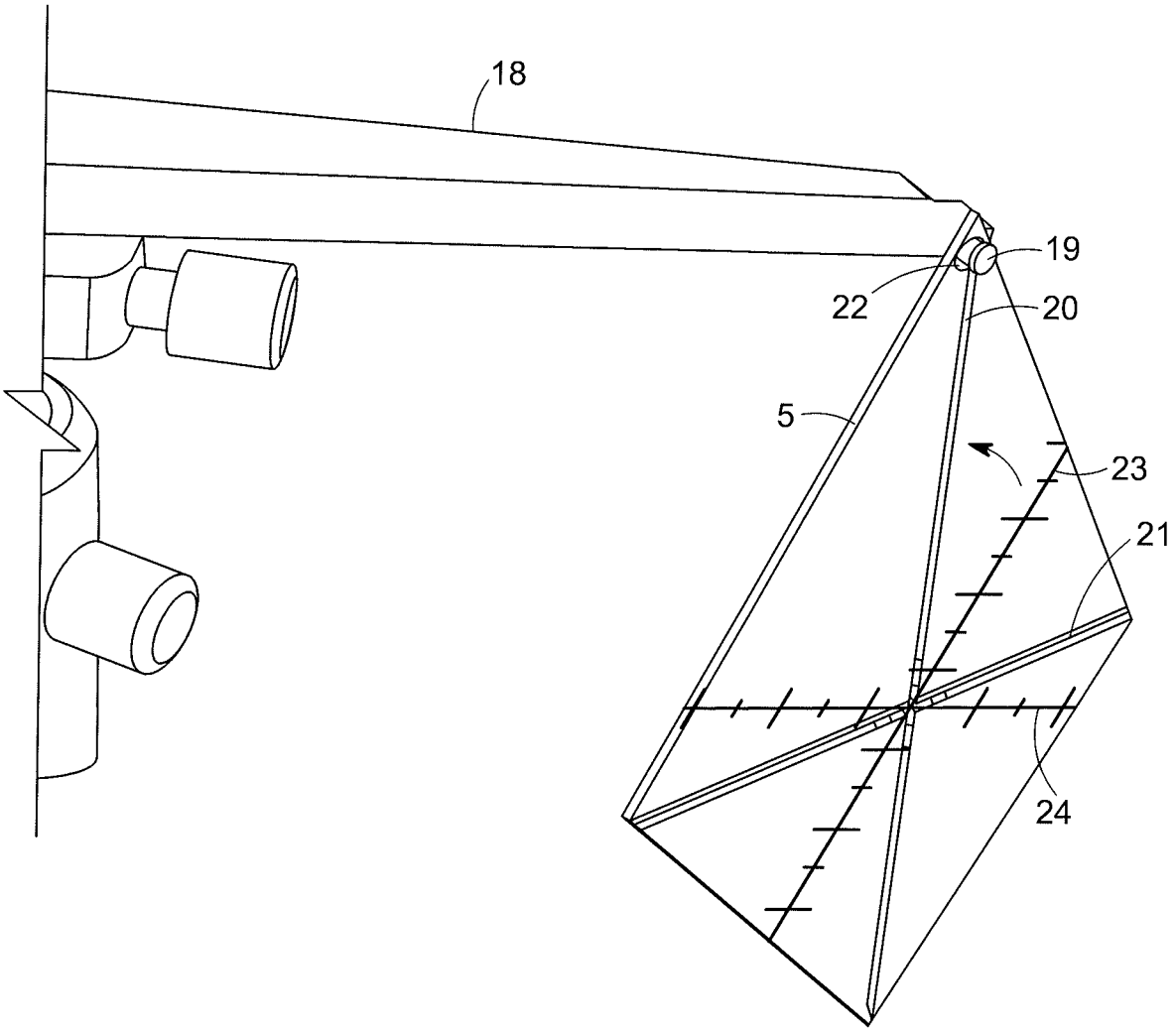
FIG. 13A illustrates another embodiment of the instant invention depicting the vertical and horizontal lines of the diamond-shaped target and the vertical and horizontal shadows of the crosshairs of the rifle scope.

FIG. 13A depicts the holding arm 18 having a pin 19 that penetrates a rounded hole 22 of the diamond-shaped target 5. The rounded hole is equally disposed on the right half and the left half of the diamond-shaped target 5. FIG. 13A also depicts the vertical line 20 extending from the middle of the rounded hole 22 down the length of the diamond-shaped target 5. The vertical line 20 intersects at a right angle the horizontal line 21 of the diamond-shaped target 5. FIG. 13A depicts the crosshair's vertical shadow 23 and the crosshair's horizontal shadow 24 as the light source (not depicted) illuminates the cross hairs inside of the rifle scope, which casts the crosshair's shadow onto the diamond-shaped target 5. FIG. 13 a depicts a counterclockwise arrow between the crosshair's vertical shadow 23 and the vertical line 21 of the diamond-shaped target 5. In this case, the rifle scope would be rotated counterclockwise in order to achieve rifle scope alignment between the rifle barrel and the rifle scope crosshairs.

Figure 13B:
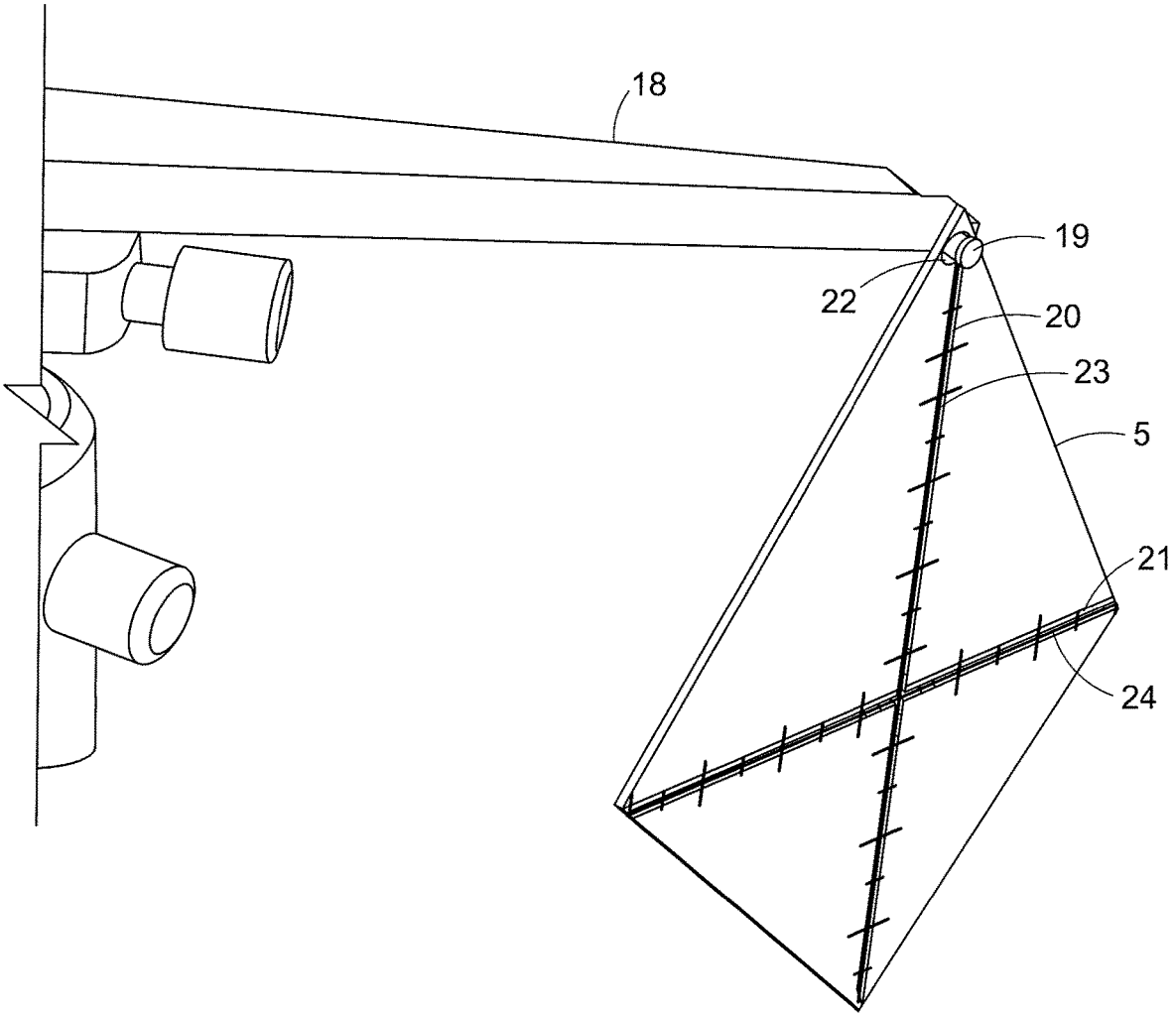
FIG. 13B illustrates another embodiment of the instant invention depicting alignment of the shadows of the crosshairs of the rifle scope with the vertical and horizontal lines of the diamond-shaped target.

FIG. 13B depicts the counterclockwise adjustment corresponding to the arrow of FIG. 13A. At this point, the crosshairs vertical shadow 23 is aligned with the vertical line 20 of the diamond-shaped target 5 and the crosshairs horizontal shadow 24 is aligned with the horizontal line 21 of the diamond-shaped target 5.

In other embodiments of the instant invention the holding arm 18 comprises a rounded hole and the diamond-shaped target comprises a pin that inserts into the rounded hole of the holding arm 18. In this embodiment, the pin would be protruding from the top of the diamond-shaped target and would be disposed centrally, equally between the right half and the left half of the diamond-shaped target The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

While this invention has been described in terms of several embodiments, there are alterations, permutations, and equivalents, which fall within the scope of this invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A rifle scope alignment apparatus comprising a top brace, a bottom brace, a light source, a light source chassis, a cavity, a flat top v-groove, a level, a posterior portion, and an anterior portion;

said anterior portion comprised of said first stepped wedge and a second stepped wedge, and said first stepped wedge in contact with said top brace and said bottom brace; said second stepped wedge disposed opposing said first stepped wedge, and said second stepped wedge in contact with said top brace and said bottom brace;

said cavity disposed between said top brace and said bottom brace, said cavity disposed between said anterior portion and said posterior portion, and said cavity disposed between said first stepped wedge and said second stepped wedge; said first stepped wedge and said second stepped wedge adapted to contact a rifle scope front end;

said light source chassis in contact with said posterior portion, said light source chassis in contact with said light source;

said flat top v-groove attached to said bottom brace, and said flat top v-grove adapted to be attached to a rifle barrel; and said level attached to said top brace.

2. The rifle scope apparatus of claim 1, further comprising an elevated diamond-shaped target having a top portion and a centrally located and circular hole disposed at the top portion, said elevated diamond-shaped target disposed a distance from said rifle scope.

3. The rifle scope apparatus of claim 2, wherein said elevated diamond-shaped target further comprising an anterior surface, said anterior surface further comprising a vertical line and a horizontal line disposed beneath said centrally located and circular hole, said vertical line intersects said horizontal line.

4. The rifle scope alignment apparatus of claim 1, wherein the chassis further comprises holes and the rifle scope alignment apparatus further comprises a cord going through said holes and said cord attached to a rifle scope.

5. The rifle scope alignment apparatus of claim 1, wherein the flat top v-groove comprises one or more magnets.

6. A rifle scope alignment apparatus comprising a top brace, a bottom brace, a light source, a light source chassis, a cavity, a flat top v-groove, a level, an elevated diamond-shaped target, a posterior portion, and an anterior portion;

said anterior portion comprised of said first stepped wedge and a second stepped wedge, and said first stepped wedge in contact with said top brace and said bottom brace; said second stepped wedge disposed opposing said first stepped wedge, and said second stepped wedge in contact with said top brace and said bottom brace; said cavity disposed between said top brace and said bottom brace, said cavity disposed between said anterior portion and said posterior portion, and said cavity disposed between said first stepped wedge and said second stepped wedge;

said first stepped wedge and said second stepped wedge adapted to contact a rifle scope front end; said light source chassis in contact with said posterior portion, said light source chassis in contact with said light source;

said flat top v-groove attached to said bottom brace, and said flat top v-grove adapted to be attached to a rifle barrel; said level attached to said top brace;

said elevated diamond-shaped target having a top portion and a centrally located and circular hole disposed at the top portion, said elevated diamond-shaped target disposed a distance from said rifle scope.

7. The rifle scope apparatus of claim 6, wherein said elevated diamond-shaped target further comprising an anterior surface, said anterior surface further comprising a vertical line and a horizontal line disposed beneath said centrally located and circular hole, said vertical line intersects said horizontal line.

8. The rifle scope apparatus of claim 6, wherein said elevated diamond-shaped target further comprising an anterior surface, said anterior surface further comprising a vertical line and a horizontal line disposed beneath said centrally located and circular hole, said vertical line intersects said horizontal line.

9. The rifle scope alignment apparatus of claim 6, wherein the chassis further comprises holes and the rifle scope alignment apparatus further comprising a cord going through said holes and said cord attached to a rifle scope.

10. The rifle scope alignment apparatus of claim 6, wherein the flat top v-groove comprises one or more magnets.

11. A rifle scope alignment apparatus comprising a top brace, a bottom brace, a light source, a light source chassis, a cavity, a flat top v-groove, a level, an elevated diamond-shaped target, a posterior portion, and an anterior portion;

said anterior portion comprised of said first stepped wedge and a second stepped wedge, and said first stepped wedge in contact with said top brace and said bottom brace; said second stepped wedge disposed opposing said first stepped wedge, and said second stepped wedge in contact with said top brace and said bottom brace; said cavity disposed between said top brace and said bottom brace, said cavity disposed between said anterior portion and said posterior portion, and said cavity disposed between said first stepped wedge and said second stepped wedge;

said first stepped wedge and said second stepped wedge adapted to contact a rifle scope front end; said light source chassis in contact with said posterior portion, said light source chassis in contact with said light source; said flat top v-groove attached to said bottom brace, and said flat top v-grove adapted to be attached to a rifle barrel; said level attached to said top brace;

said elevated diamond-shaped target having a top portion and a centrally located and circular hole disposed at the top portion, said elevated diamond-shaped target disposed a distance from said rifle scope; and said elevated diamond-shaped target further comprises an anterior surface, said anterior surface further comprising a vertical line and a horizontal line disposed beneath said centrally located and circular hole, said vertical line intersects said horizontal line.

12. The rifle scope apparatus of claim 11, wherein said elevated diamond-shaped target further comprising an anterior surface, said anterior surface further comprising a vertical line and a horizontal line disposed beneath said centrally located and circular hole, said vertical line intersects said horizontal line.

13. The rifle scope alignment apparatus of claim 11, wherein the chassis further comprises holes and the rifle scope alignment apparatus further comprises a cord going through said holes and said cord attached to a rifle scope.

14. The rifle scope alignment apparatus of claim 11, wherein the flat top v-groove comprises one or more magnets.

* * * * *